US005964614A

United States Patent [19]

Daoud

[11] Patent Number: 5,964,614

[45] Date of Patent: Oct. 12, 1999

[54] CONNECTOR WITH BUILT-IN SAFETY FEATURE

[75] Inventor: Bassel H. Daoud, Parsippany, N.J.

[73] Assignee: Lucent Technologies, Inc., Murray Hill, N.J.

[21] Appl. No.: 09/108,331

[22] Filed: Jun. 30, 1998

[51] Int. Cl.[6] ..... H01R 4/24

[52] U.S. Cl. ..... 439/417; 379/399

[58] Field of Search ..... 439/417, 409, 439/676; 379/399, 412, 438, 332

[56] References Cited

U.S. PATENT DOCUMENTS

| | | | |
|---|---|---|---|
| 4,396,809 | 8/1983 | Brunssen | 179/175 |
| 4,913,659 | 4/1990 | Doyle | 439/395 |
| 5,004,433 | 4/1991 | Daoud | 439/502 |
| 5,222,908 | 6/1993 | Baker, III et al. | 439/557 |
| 5,240,432 | 8/1993 | Daoud | 439/417 |
| 5,681,182 | 10/1997 | Reichie | 439/417 |
| 5,721,396 | 2/1998 | Daoud | 174/59 |
| 5,740,685 | 4/1998 | Daoud | 70/164 |

OTHER PUBLICATIONS

Egerton, Advertisement entitled "Mini–Rocker Cross Connect".

*Primary Examiner*—Steven L. Stephan
*Assistant Examiner*—Javaid Nasri
*Attorney, Agent, or Firm*—Duane Morris and Heckscher LLP; Steven E. Koffs

[57] ABSTRACT

A customer bridge configuration (110) allows connection or disconnection of customer-side lead wires when the customer wiring is disconnected from the external telephone network, but prevents connection or disconnection of customer-side lead wires when the customer wiring is connected to the external telephone network. A connector (120) is mounted to a housing (112). The connector (120) includes two terminals (123) and at least one movable portion (122) mounted over the terminals. A wire (132) is engaged by the housing (112). The wire (132) extends from a position in a top surface of the housing (112), and may be wrapped within cladding as part of a cable (130) The wire (132) has an end terminating in a plug(152). An RJ11 jack receives the plug (152). The jack (153) provides an electrical connection to an outside circuit (164). The wire (132) is long enough for the plug (152) to reach the jack (153) when the movable portion (122) is in the closed position, but too short for the plug (152) to reach the jack (153) when the movable portion (122) is in the open position. The connector (120) is between the jack (153) and the position in the top surface of the housing (112) from which the cable (130) extends. The movable portion (122) includes holes (124) for insertion of customer-side lead wires. The movable portion (122) has an open (raised) position, and a closed (lowered) position for connecting the terminal (123) to the customer-side lead wires.

15 Claims, 3 Drawing Sheets

CONNECTOR WITH BUILT-IN SAFETY FEATURE

TECHNICAL FIELD

The present invention relates to interconnection devices generally, and more specifically to a device used at a network interface between a telephone network and customer premises equipment.

BACKGROUND OF THE INVENTION

Telephone companies own the telephone network wires outside of privately owned buildings, while the owners of the buildings own the telephone wiring inside the buildings. An interface, known as a customer bridge, is provided at the entrance to the building, where the telephone company wires meet the building wires. The customer bridge has a customer connector assembly to which the customer's telephone lines are all electrically coupled. The connector assembly may include any of a variety of known terminals or connectors for attaching customer lead wires.

The customer bridge also includes a network interface device (NID). The NID typically includes a jack (which may be a standard RJ11 jack) which is coupled to the external telephone network. The customer wires typically terminate in a mating RJ11 plug, which is normally inserted in the RJ11 jack of the NID.

Nominally, the telephone lines operate at low voltage conditions, but a high voltage condition may occur, for example, due to lightning. To protect a user who may be connecting or disconnecting telephone lead wires to/from the customer interface connectors, Underwriters Laboratories (UL) requires that the customer interface be disconnected from the external network by unplugging the RJ11 plug from the RJ11 jack at the entrance to the property, before performing work on the internal building wires. This requirement is enforced by way of warning labels and instructions. Thus, it is up to the individual who is handling the wires to read the warning/instructions and execute this safety procedure.

SUMMARY OF THE INVENTION

The present invention is a customer bridge configuration which allows connection or disconnection of customer-side lead wires when the customer wiring is disconnected from the external telephone network, but prevents connection or disconnection of customer-side lead wires when the customer wiring is connected to the external telephone network.

The connector assembly includes a housing. A wire is engaged by the housing. The wire has an end terminating in a plug.

A connector is mounted to the housing. The connector includes a terminal and a movable portion mounted over the terminal. The movable portion of the connector includes a hole into which an additional wire is inserted. The movable portion of the connector has an open position and a closed position for connecting the terminal to the additional wire.

A jack is adapted to receive the plug. The jack provides an electrical connection to an outside circuit. The jack is positioned, relative to the housing, so that the plug is insertable in the jack when the movable portion of the connector is in the closed position, and the plug is not insertable in the jack when the movable portion of the connector is in the open position.

These and other aspects of the invention are described in detail below, with reference to the accompanying drawings and the exemplary embodiments.

DETAILED DESCRIPTION

Figure 1B:
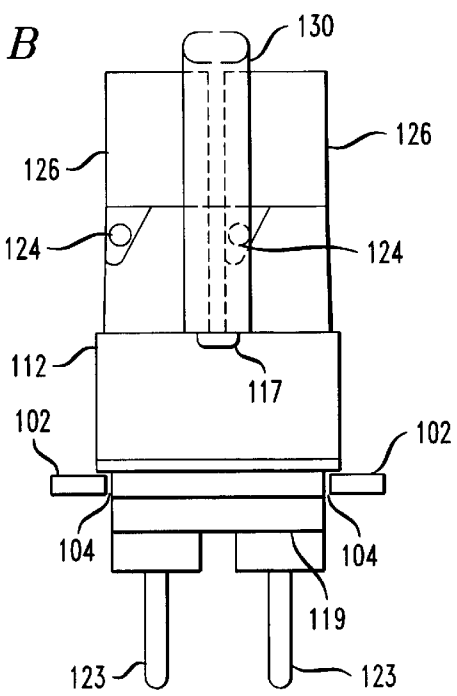
FIG. 1B is a side elevation view of the embodiment of FIG. 1A.
Figure 1A:
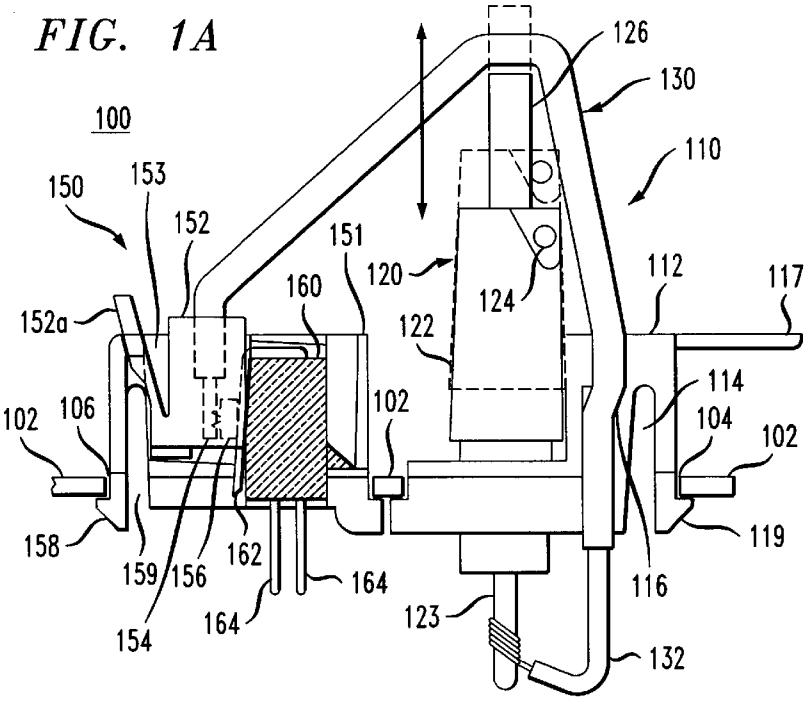
FIG. 1A is a front elevation view of a first exemplary embodiment of the invention.
Figure 1C:
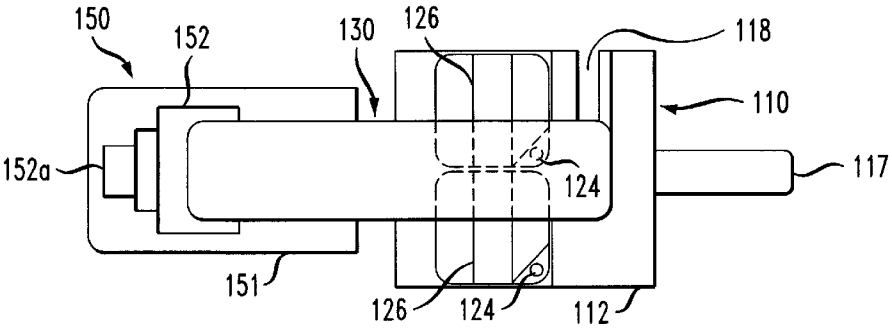
FIG. 1C is a plan view of the embodiment of FIG. 1A.

The invention is a connector assembly 100 in which a customer bridge 110 is provided at the entry point at which wires 164 from an external telephone network enter a customer's house. FIGS. 1A to 1C show an exemplary connector assembly 100 according to the present invention. A housing 112 is provided. A cable 130 is engaged by the housing 112. The wire 130 has an end terminating in a plug 152.

A connector 120 is mounted to the housing 112. The connector 120 includes a terminal 123 and a movable portion 122 mounted over the terminal 123. The movable portion 122 includes a hole 124 for insertion of an additional lead wire (not shown). The movable portion 122 has an open (raised) position, (shown in phantom in FIG. 1A), and a closed (lowered) position (shown in solid lines in FIG. 1A) for connecting the terminal 123 to the additional lead wire. The exemplary movable portion 122 is a cap having a flat top portion 126. As shown in FIGS. 1B and 1C, a second terminal 123 with a second cap 126 and a respective second hole 124 may also be provided.

A jack 153 is adapted to receive the plug 152. The jack provides an electrical connection to an outside circuit 164. The jack 153 is positioned relative to the housing 112, so that the plug 152 is insertable in the jack 153 when the movable portion 122 is in the closed position. The plug 152 is not insertable in the jack 153 when the movable portion 122 is in the open position.

The wire 132 has a length which is long enough for the plug 152 to reach the jack 153 when the movable portion 122 is in the closed position, but too short for the plug 152 to reach the jack 153 when the movable portion 122 is in the open position.

The wire 132 extends from a position in a top surface of the housing 112, and may be wrapped within cladding as part of a cable 130. The housing 112 is positioned so that the connector 120 is between the jack 153 and the position in the top surface of the housing 112 from which the cable 130 extends. These and other features of the invention are described below with reference to the exemplary embodiments.

The assembly 100 includes two main components.

First, a customer-side connector assembly 110 provides the interface to which all telephone wires within the customer's house are connected. As explained in greater detailed below, the customer-side assembly includes a pair of holes 124, to receive lead wires (not shown) from the telephone(s) inside the customer's house.

Second, a network interface device (NID) 150 is also provided. The NID 150 provides the connection to the external telephone network. The external wires 164 terminate in a standard plug 160, which may be, for example, a type-645 plug. The type-645 plug 160 is inserted into the bottom of the NID 150. A plug 152, which may be, for example, a standard RJ11 plug 152 is inserted into the top of the network interface device (NID) 150. As described in detail below, when the plug 152 is inserted into the jack 153 of NID 150, a conductive path is established between the external wires 164 entering the house or building, and the user terminals 123 that are accessed via holes 124.

To test the quality of the telephone lines, or to determine whether any anomaly in service is due to a problem in the external network or a problem in the lines within the house, plug 152 is removed from the RJ11 jack 153. A standard telephone device (not shown) is connected directly to the RJ11 jack 153. If the user hears a normal dial tone, this is an indication that the external network wires outside of the house are functioning properly, and that any anomaly is due to a problem within the house wires. If, on the other hand, a normal dial tone is not heard, then the anomaly is due to a problem in the external network.

The exemplary embodiment shown in FIGS. 1A through 1C provides an inherent safety feature. In order for a customer to connect or disconnect lead wires to or from the holes 124, the RJ11 plug 152 must be disconnected from the RJ11 jack. By removing the plug 152 from the RJ11 jack, the circuit path between the customer's telephone lines and the external network is interrupted. Thus, the customer is protected from any power surge, ground fault, or abnormal voltage condition which may occur outside of the house.

More specifically, according to the invention, a customer-side connector assembly 110 includes connectors 120, having at least two positions. In one of the positions (as shown in phantom in FIG. 1A), the top portion 126 of the connector 120 displaces the cable 130 to which the plug 152 is attached. In this open position, the connector assembly 120 prevents the insertion of plug 152 into the RJ11 jack 153, because the length of the cable 130 does not allow the cable to reach over the top of the connector 120 and into the RJ11 jack 153.

Referring more specifically to FIGS. 1A to 1C, housing 112 has a pair of connectors 120, to which the customer leads (not shown) are attached. The connectors 120 may be, for example, of a type similar to those shown and described in any of U.S. Pat. Nos. 4,913,659 to Doyle, 5,004,433 to Daoud, or 5,240,432 to Daoud, all of which are expressly incorporated by reference herein in their entireties. Preferably, the connector is an insulation displacement connector (IDC) device. IDC connector 120 has a cap 122 which has a raised position and a lowered position. Connector 120 includes a pair of terminals 123 extending throughout the length of connector 120. To connect lead wires to the connector 120, cap 122 of the connector is raised to the open position, and the lead wire is inserted into the hole 124. In this position, the lead wire is engaged by a top portion of the terminals 123. When the cap 122 is pushed down into the closed (lower) position, sufficient insulation is displaced from the lead wire to create an electrical connection between the lead wire and the terminal 123.

The housing 112 mounts to a standard panel, which maybe a sheet metal panel, as widely used in the field. A typical latched type mounting 119 maybe used. Housing 112 also includes a passage 116 which has an offset for gripping the cable 130. A housing with an offset position is described in greater detail in U.S. Pat. No. 5,004,433 to Daoud which is expressly incorporated by reference herein. Housing 112 also includes stress relief by the provision of channels 114 and 118, as shown in FIGS. 1A and 1C, respectively. The stress relief technique is described in greater detail in U.S. Pat. No. 5,004,433.

Wires 132 extending from the bottom of cable 130 are wrapped around the terminals 123 in a conventional manner. As best seen in FIG. 1A, cable 130 is inserted into the housing 112 to establish a predetermined length of cable between the top surface of housing 112 and the plug 152, so that the cable 130 is approximately in contact with the top 126 of the cap 122 when the cap 122 is in the closed (lower) position. However, when the cap 122 is in the raised (open) position, the same predetermined length of cable 130 is insufficient for the cable 130 to extend over the top 126 of the cap 122 and still reach the RJ11 jack 153.

Thus, when the cap 120 is in the open position, the plug 152 cannot be inserted into the RJ11 jack 153. The user must close the connector 120 by pushing the cap 122 down into its lower position; otherwise, the user is unable to insert the plug 152 into the RJ11 jack 153.

The network interface device as shown in FIG. 1A provides a direct conductive connection between the 645-type plug 160 of the external network, and the plug 152 by way of a standard RJ11 jack 153. This configuration provides a small footprint. One of ordinary skill in the art recognizes that an alternative NID (not shown) having an intermediate conductor between plug 160 and plug 152 may also be used to provide the electrical connection between the RJ11 jack 153 and the external network. Such an alternative configuration would, however, likely result in an increased footprint.

The customer bridge 110 and NID 150 may be mounted onto a sheet metal panel having standard rectangular mounting slots 104 and 106. The standard spacing between slots 104 and 106 defines a fixed spacing between the housing 112 of the customer interface assembly 110 and the housing 151 of the network interface device 150. Thus, for any standard panel with standard spacing between slots 104 and 106, the exact length of cable 130 extending from a top surface of the housing 112 maybe determined in advance.

Alternatively, the customer connector 110 may be mounted on the panel 102 with the connectors 120 in the closed position. In this assembly method, plug 152 is inserted into the RJ11 jack in the mounted network interface device 150, and the length of cable 130 is determined by stretching the cable 130 relatively tightly over the top 126 of the cap 122 of connector 120. Then the cable 130 is inserted into the housing 112 to fix the free length of cable 130.

One of ordinary skill in the art recognizes that a standard mounting panel 102 includes rectangular openings into which the customer interface assembly 110 is placed. Because the opening are rectangular, it is possible that the housing 112 could be inserted into the hole 104 of panel 102 in an incorrect orientation. Thus, an optional means may be provided for preventing the housing 112 from being mounted in a position in which the plug 152 would be inserted into the jack 153 while the movable portion 122 of the cap 120 is in the open position. For example, a tab 117 maybe provided to prevent housing 112 from being inserted in a position 180 degrees away from the correct position. In other words, the tab 117 would interfere with the mounting of NID 150, if this incorrect orientation were used.

One of ordinary skill in the art recognizes that a variety of other mechanical means may be used to prevent the housings 112 and 151 from being inserted with incorrect orientations. For example, a projecting member could be placed on the end of the housing 151 of NID 150 which faces away from the customer interface. In the same manner, such a device would prevent the NID 150 from being oriented in a position 180 degrees away from its prescribed position. Alternatively, the sheet metal openings 104 and 106 may have non-symmetric openings; non-symmetric openings will only accept the housings 112 and 151, respectively, if they are oriented properly.

Figure 2B:
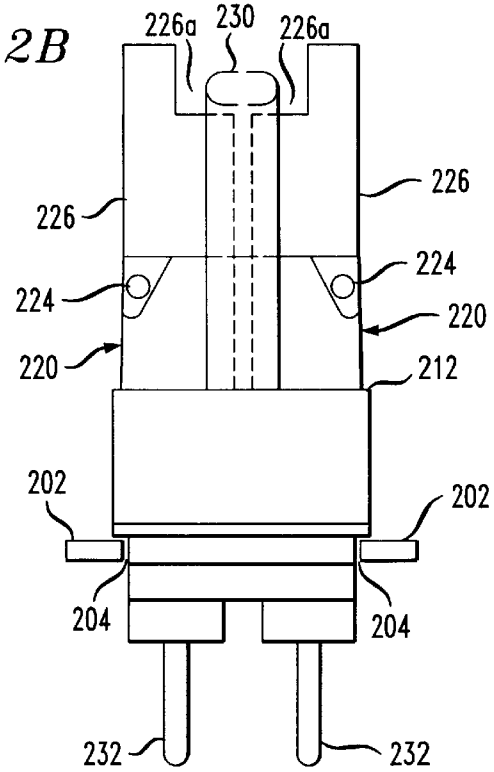
FIG. 2B is a side elevation view of the embodiment of FIG. 2A.
Figure 2A:
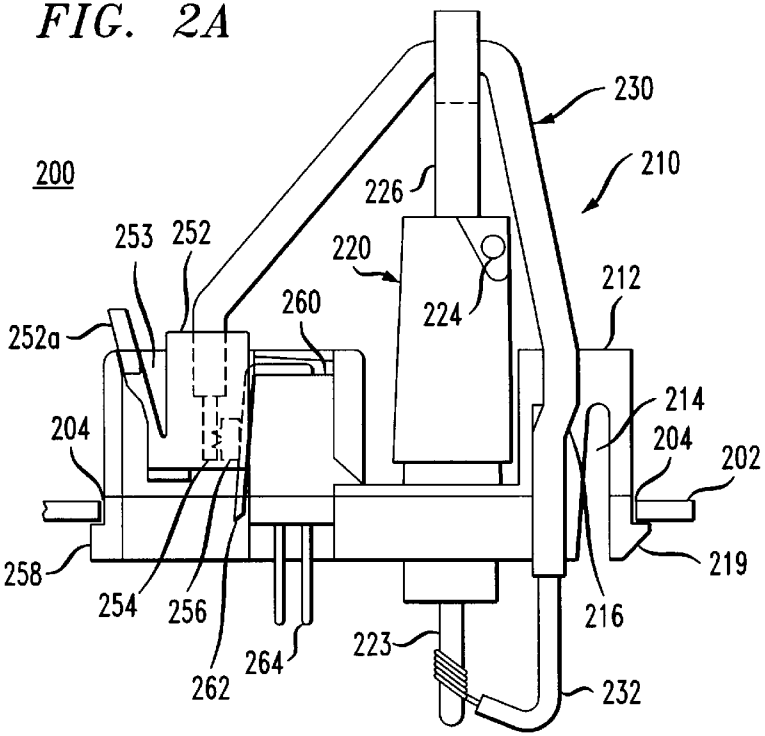
FIG. 2A is a front elevation view of a second exemplary embodiment of the invention.
Figure 2C:
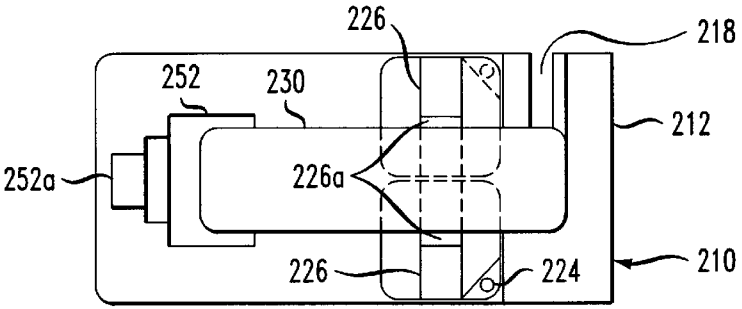
FIG. 2C is a plan view of the embodiment of FIG. 2A.

FIGS. 2A to 2C show a second exemplary embodiment of the invention. The exemplary assembly 200 of FIGS. 2A to 2C operates according to the basic principles of the invention of FIGS. 1A to 1C. However, to eliminate the possibility of the customer connector assembly 110 being mounted in an incorrect position or orientation relative to the network interface device 150, the customer interface 110 and NID 150 may both be mounted on a single housing 212. The embodiment of FIGS. 2A to 2C has the advantage of being pre-configurable. Because the spatial relationship between the customer interface and the network interface are fixed by the design of housing 212, the cable 230 can be easily pre-installed, with the correct predetermined length extending from the top surface of housing 212, and the plug 252 inserted in the RJ11 jack 253 before the housing 212 is installed in the panel 202. Thus, to install interface connector assembly 200 as shown in FIGS. 2A through 2C, it is only necessary to insert the 645-type plug 260 into the corresponding jack 253 in the bottom of housing 212, and then insert the housing 212 into the opening 204 in the sheet metal panel 202 (for example, by using the housing latch mechanism 219).

With a single housing 212, there is no need to provide any additional means for preventing the housing 212 from being mounted in a position which would allow insertion of the jack 252 into the RJ11 plug 253 while the connectors 220 are open. Thus the optional tab 117 described above with reference to the embodiment of FIGS. 1A through 1C is not included in housing 212.

A further difference between the embodiment of FIGS. 1A to 1C and the embodiment of FIGS. 2A to 2C is the provision of a notch 226*a* in the top section 226 of the cap 220. As best seen in FIG. 2B, each cap 220 has a cut out section 226*a* in its top 226. The two cut outs 226*a* combine to form a central notch through which the cable 230 passes. Alternatively, a notch or groove maybe placed in the top 226 of each respective cap 220; an individual wire 232 would then pass through each respective groove or notch. The notch configuration shown in FIGS. 2A through 2C would make it even more difficult to open the caps 220 without first removing the plug 252 from the RJ11 jack 253. Essentially, the configuration shown in FIGS. 2A and 2B allows use of a shorter length for cable 230. It would be extremely difficult to stretch this cable 230 enough to slide it over the top 226 of the connector 220, without damaging the assembly 200. Thus, the user is very likely to unplug the plug 252 from the RJ11 jack 253 before trying to open the connectors 220. This is the safest procedure and is the preferred operation.

The connector 220 shown in FIG. 2B has the holes 224 located symmetrically about the center, so that there is less likelihood of interference between the cable 230 and the lead wires (not shown). One of ordinary skill recognizes that either the symmetrical configuration of holes 224 or the asymmetrical configuration of holes 124 (FIG. 1B) may be used, whichever is preferred.

All of the remaining features shown in FIGS. 2A through 2C are similar to those shown in FIGS. 1A through 1C, and a description thereof is not repeated herein. One of ordinary skill further recognizes that the reference numerals in FIG. 2A for items which are identical to the parts of FIG. 1A have the same last 2 digits as the corresponding items in FIGS. 1A.

Figure 3B:
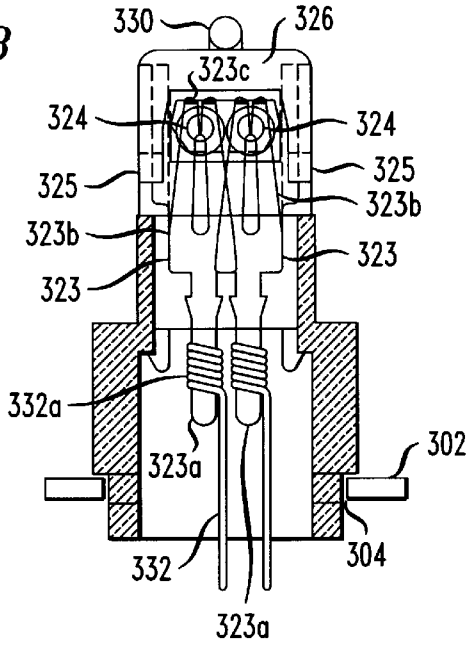
FIG. 3B is a side elevation view of the embodiment of FIG. 3A.
Figure 3A:
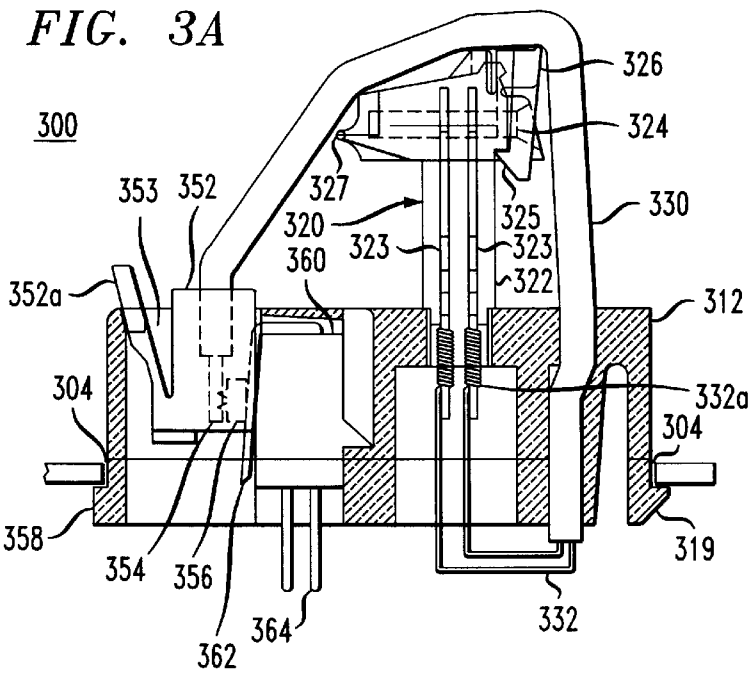
FIG. 3A is a front elevation view of a third exemplary embodiment of the invention.
Figure 3C:
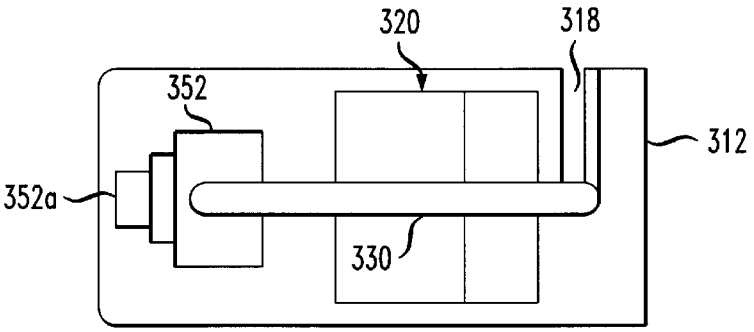
FIG. 3C is a plan view of the embodiment of FIG. 3A.

FIGS. 3A to 3C show a further exemplary embodiment of the invention. The connector assembly 300 primarily differs from the embodiments of FIGS. 1A to 1C and 2A to 2C in that assembly 300 includes a different connector 320 on the customer interface side. Connector 320 is a compact insulation displacement connector having a single cap mechanism 326 for a pair of terminals 323. For example, connector 320 maybe a single connector of the type used in the 10-pair mini-rocker module RBC2100 manufactured by the Egerton Company of Cheshire, England. The aforementioned Egerton module includes 10 rocker switches, which are connected side by side with linking plastic tabs. Contiguous mini-rocker switches are easily separated from one another by simple mechanical cutting operations, as understood by those skilled in the art.

The exemplary connector 320 includes a pair of terminals 323. Each terminal extends beneath the base 312 and is connected by wire wrap 332*a* to lead wires 332. Each of the terminals 323 has a bottom portion 323*a* for the wire wrap 332*a* and a top portion 323*b*. The top portion 323*b* includes a pair of upwardly extending cutting tangs 323*c* for receiving lead wires. Cap 326 of the connector 320 has two holes 324 which are aligned with the cutting tangs 323*c*. Cap 326 is movable with respect to the lower portion 322 of connector 320. When the cap 326 is in its open, upper position (not shown), lead wires may be inserted into the holes 324. Subsequently, when the cap 326 is pivoted downward, about a pivot point 327 (which may for example be a living hinge), the lead wires are forced downward, each between a respective pair of cutting tangs 323*c*. As the wires are squeezed between the cutting tangs 323*c*, a sufficient amount of insulation is displaced from the lead wires to form an electrical connection between terminals 323 and the lead wires.

One of ordinary in the art recognizes that the compact connector device shown in FIGS. 3A to 3C is just an example; a variety of connector types may be used. What is important is that the connector has two positions, an open position and a closed position. When the connector is in its closed position, the length of cable 330 is sufficient to insert plug 352 in RJ11 jack 353. When the connector 320 is in its open position, the length of cable 330 is too short to insert the plug 352 into the RJ11 jack 353, due to interference from the movable portion of the connector 320.

Variations of the connector shown are contemplated. For example, connector 320 includes two latches 325 positioned on either side of the terminals 323. In accordance with the present invention, a cap 326 of connector 320 may have a single latch (not shown) positioned in between the holes 324. By placing the latch in between the holes, terminals 323 would be moved further apart. Moving terminal 323 apart has multiple advantages. First, by further separating terminal 323 from one another, parasitic couplings are reduced. Second, the terminals 323 may be spaced apart from one another sufficiently to eliminate any overlap between the terminals 323. As a result, it is possible to put position of the terminals 323 in a single plane. This allows a reduction in the size of the connector 320, because the terminals 323 would not have to be spaced apart from one another as shown in FIG. 3A.

One of ordinary skill in the art recognize that the embodiment shown in FIGS. 1A through 3C are only examples and that all of the individual features shown in these different examples maybe "mixed and matched". For example, a notch configuration shown in FIGS. 2A to 2C may be used with a connector similar to that shown in FIGS. 3A through 3C, by modifying the shape of the cap 236.

Further although the three exemplary embodiments described above all include a network interface device (e.g. 150) having the RJ11 plug 152 in direct contact with the conductors 162 of the 645-type plug 160, another conventional network interface device providing electrical conductive coupling between the plug 152 and the 645-type connector 160 may be used.

Although the examples show a pair of wires 132 wrapped in a cladding layer to form a cable 130, the invention may be practiced with or without the cladding. Further, the cladding consist of a single flexible layer, or the cladding may include a second, rigid outer cladding over a portion of its length between the top of the housing and the plug. The rigid outer cladding layer may be used to pre-determine the cable length for the embodiment shown in FIGS. 1A to 1C.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A connector assembly comprising:

a housing;

a wire engaged by said housing, the wire having an end terminating in a plug;

a connector mounted to said housing, said connector including a terminal and a movable portion mounted thereover, the movable portion including a hole for insertion of an additional wire therein, the movable portion having an open position and a closed position for connecting the terminal to the additional wire; and a jack adapted to receive the plug, said jack providing an electrical connection to an outside circuit, said jack being positioned relative to the housing so that said plug is insertable in the jack when the movable portion is in the closed position, and said plug is not insertable in the jack when the movable portion is in the open position.

2. The assembly according to claim 1, wherein the wire has a length which is long enough for the plug to reach the jack when the movable portion is in the closed position, but too short for the plug to reach the jack when the movable portion is in the open position.

3. The assembly according to claim 1, wherein the movable portion is a cap.

4. The assembly according to claim 3, wherein the cap has a flat top.

5. The assembly according to claim 3, wherein the cap has a top, and the top has a slot or a cut-out corner.

6. The assembly according to claim 1, wherein the movable portion has a second terminal and a second hole for insertion of a second additional wire therein, the second additional wire being connected to the second terminal when the movable portion is in the closed position.

7. The assembly according to claim 1, wherein the jack and the housing are formed within a common base.

8. The assembly according to claim 1, further comprising:

a base, containing the jack, the base being separate and distinct from the housing; and a body protruding from a side of the housing, so as to prevent the housing from being mounted in an incorrect orientation.

9. The assembly according to claim 1, wherein the wire extends from an opening in a top surface of said housing, and the housing is oriented so that the connector is between said jack and said opening in the top surface of the housing.

10. A connector assembly comprising:

a housing;

a pair of wires engaged by said housing, each one of the pair of wires having an end terminating in a plug;

a pair of connector elements connected to said housing, each connector element including a terminal and a cap slidably mounted thereover, each cap including a hole for insertion of an additional wire therein, each cap having an open position and a closed position for connecting the terminal to the additional wire; and a jack adapted to receive the plug, said jack providing an electrical connection to an outside circuit, said jack being positioned relative to the housing so that said plug is insertable in the jack when each of the caps is in the closed position, and said plug is not insertable in the jack when either of the caps is in the open position.

11. The assembly according to claim 10, wherein the pair of wires has a length which is long enough for the plug to reach the jack when each of the caps is in the closed position, but too short for the plug to reach the jack when either of the caps is in the open position.

12. A method for assembling a connector assembly, comprising the steps of:

providing a housing having a connector mounted to said housing, the connector including a terminal and a movable portion mounted thereover, the movable portion including a hole for insertion of a first wire therein, the movable portion having an open position and a closed position for connecting the terminal to the first wire; and fixing an outside wire to said housing, the outside wire having an end terminating in a plug;

positioning, relative to said housing, a jack adapted to receive the plug, said jack providing an electrical connection to an outside circuit, said positioning being performed so that said plug is insertable in the jack when the movable portion is in the closed position, and said plug is not insertable in the jack when the movable portion is in the open position.

13. The method of claim 12, further comprising the step of adjusting the length of the outside wire, so that the outside wire is long enough for the plug to reach the jack when the movable portion is in the closed position, but too short for the plug to reach the jack when the movable portion is in the open position.

14. The method of claim 12, wherein the movable portion of the connector is a cap, the method further comprising the steps of:

providing a slot or a cut-out at a top end of the cap; and passing the outside wire through the slot or cut-out to insert the plug in the jack.

15. The method of claim 12, wherein the outside wire extends from an opening in a top surface of said housing, the method further comprising the step of:

orienting the housing so that the connector is between said jack and said opening in the top surface of the housing.

* * * * *